US007168920B2

(12) United States Patent
Liu

(10) Patent No.: US 7,168,920 B2
(45) Date of Patent: Jan. 30, 2007

(54) FAN BASE CASE

(75) Inventor: Chih-Hung Liu, Taipei (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 88 days.

(21) Appl. No.: 10/938,612

(22) Filed: Sep. 13, 2004

(65) Prior Publication Data

US 2006/0056966 A1 Mar. 16, 2006

(51) Int. Cl.
*F01D 9/00* (2006.01)
*F01D 9/06* (2006.01)

(52) U.S. Cl. ..... 415/220; 415/224; 416/244 R

(58) Field of Classification Search ..... 415/220, 415/200, 206, 203, 224; 416/244 R
See application file for complete search history.

(56) References Cited

U.S. PATENT DOCUMENTS 5,019,735 A * 5/1991 Lee ..... 310/89
5,982,064 A * 11/1999 Umeda et al. ..... 310/90
6,462,441 B1 * 10/2002 Horng et al. ..... 310/67 R
6,726,455 B2 * 4/2004 Horng et al. ..... 417/14

FOREIGN PATENT DOCUMENTS

JP 2003163481 A * 6/2003

* cited by examiner

*Primary Examiner*—Igor Kershteyn

(57) ABSTRACT

A fan case base, which is for being mounted with a fan wheel having a hub and a plurality of fan blades surrounding the hub, includes a base support, a frame and a plurality of engaging parts. The base support is attached with the fan wheel. The frame is disposed around the periphery of the base support and provides the height thereof less than that of the fan blades. The engaging parts are disposed at the top of the frame for the fan case base being attached to an article and provide the height thereof greater than that of fan blades. The fan case base 2 can provide a best mode of guiding the airflow, enhancing the effect of cushion and shock absorption during the airflow entering the frame 22 and the fan blades 32 of the fan heel 3 not touching the frame 22 even in case of the fan case base 2 being hung vertically.

3 Claims, 5 Drawing Sheets

FAN BASE CASE

BACKGROUND OF THE INVENTION

1. Field of the Invention

The present invention is related to a base case and particularly to a fan base case.

2. Brief Description of the Related Art

The conventional base case of a cooling fan is used for being attached with a fan wheel and the combination of the base case with the fan wheel is attached to a casing of system such as a computer, a power supplier or a server corresponding to the ventilation outlet thereof. Once the fan wheel starts to run, the ambient heat of the electronic component can be dissipated outward through the ventilation outlet. Referring to FIG. 1, Taiwanese Patent Official Gazette No. 535859, entitled FAN FRAME, primarily provides a recess part 14 at the side edge 12, which is disposed outside the opening 11 of the fan frame 10, and an auxiliary intake hole 16 is formed between the recess part 14 and the opening 11 to enhance the area available for the intake air and to increase the air flow for dissipating heat.

When the fan blades 18 of the preceding conventional cooling fan 1 starts to run, the airflow can be introduced via the opening 11 and the auxiliary intake hole 16. But, due to the auxiliary intake hole 16 being disposed at the side edge 12 of the fan frame 10 outside the opening 11, a slant stop wall 13 is provided at the fan frame 10 between the auxiliary intake hole 16 and the opening 11 and turbulent flow generates at the circumferences of the opening 11 and the auxiliary intake hole 16 respectively. The turbulent flow can hit the stop walls 13 to create noise and how to reduce the noise is a subject worth us to overcome.

SUMMARY OF THE INVENTION

An object of the present invention is to provide a fan case base, which can reduce turbulent flow and noise generating by way of the air flow entering the frame and a situation of the fan blades touching the frame.

Accordingly, the fan case base of the present invention, which is for being mounted with a fan wheel having a hub and a plurality of fan blades surrounding the hub, includes a base support, a frame and a plurality of engaging parts. The base support is attached with the fan wheel. The frame is disposed around the periphery of the base support and provides the height thereof less than that of the fan blades. The engaging parts are disposed at the top of the frame for the fan case base being attached to an article and provide the height thereof greater than that of fan blades. The fan case base 2 can provide a best mode of guiding the airflow, enhancing the effect of cushion and shock absorption during the airflow entering the frame and the fan blades 32 of the fan wheel not touching the frame even in case of the fan case base being hung vertically.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
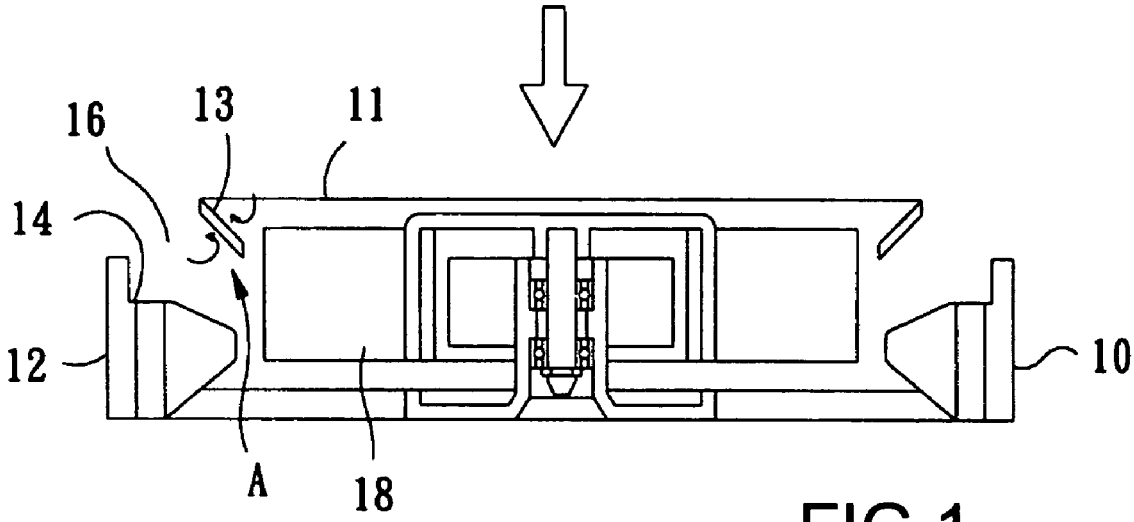
FIG 1 (PRIOR ART)
FIG. 1 is a sectional view of the fan frame disclosed in Taiwanese Patent Gazette No. 535859.
Figure 2:
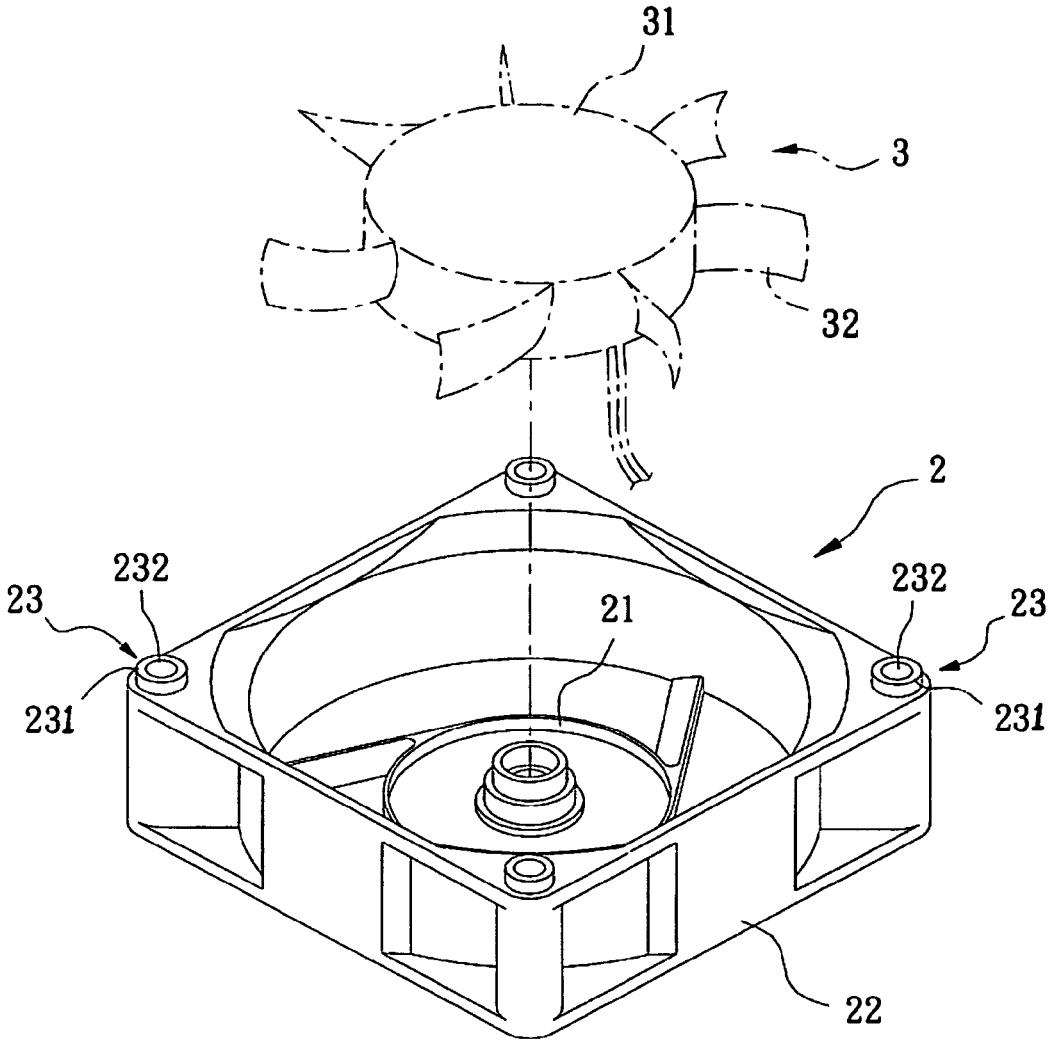
FIG. 2 is a perspective view of the first embodiment of a fan base case according to the present invention.
Figure 3:
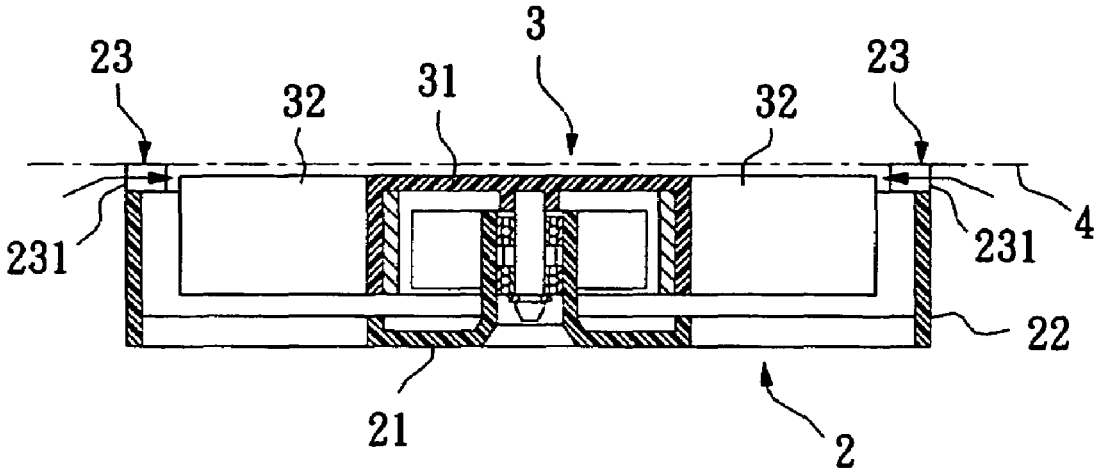
FIG. 3 is a sectional view of the fan base case shown FIG. 2 illustrating the fan base case being disposed horizontally.

Referring to FIGS. 2 and 3, a fan base case 2 of the present invention in the first embodiment thereof is used for mounting a fan wheel 3 and the fan wheel 3 includes a hub 31 and a plurality of fan blades 32 disposed at the periphery of the hub 31. The fan base case 2 includes a base support 21, a frame 22 and four engaging parts 23.

The base support 21 is attached to the frame 2 and the fan wheel 3 is rotatably joined to the center of the base support 21.

The frame 22 is provided with an air inlet side and an air outlet side and has a circular between the air inlet side and the air outlet side. The base support 21 is joined to the inner wall surface of the hollow space at the air outlet side and once the fan wheel 3 is rotatably attached to the base support 21, the outer lateral side of the fan wheel 3 extends outward the air inlet side due to the fan blades 32 have a height greater than that of the frame 22. The frame 22 illustrated in the present embodiment has a square shape.

The engaging parts 23 are located at four upper corners of the frame 22 for the fan base ease being able to be attached to an article 4 and each of the engaging parts 23 has a ring shaped element 231 with an engaging through hole 232. The ring shaped element 231 provides a height greater than the fan blades 32. The engaging parts 23 are made of rubber.

Comparing to Taiwanese Official Gazette No. 535859, the fan base case 2 of the present invention has the following advantages and effects:

1. The fan base case 2 of the present invention provides quieter running:

Referring to FIG. 3, the fan base case 2 is designed to have a height greater than that of the frame 22 and less than that of the cylindrical element 231 of each engaging part 23. In this way, there is no isolating part being disposed between the frame 22 and the fan blades 32 such that an unimpeded passage of air flow between the fan wheel 3 and the outer side and the inner side of the frame 22 for the air introduced by the fan wheel 3 avoiding to become turbulent flow hitting the inner wall of the frame 22 and occurring noise. Therefore, the fan case base 2 of the present invention can overcome disadvantages of the prior art such as the phenomenon of generating turbulent flow and occurring noise.

Figure 4:
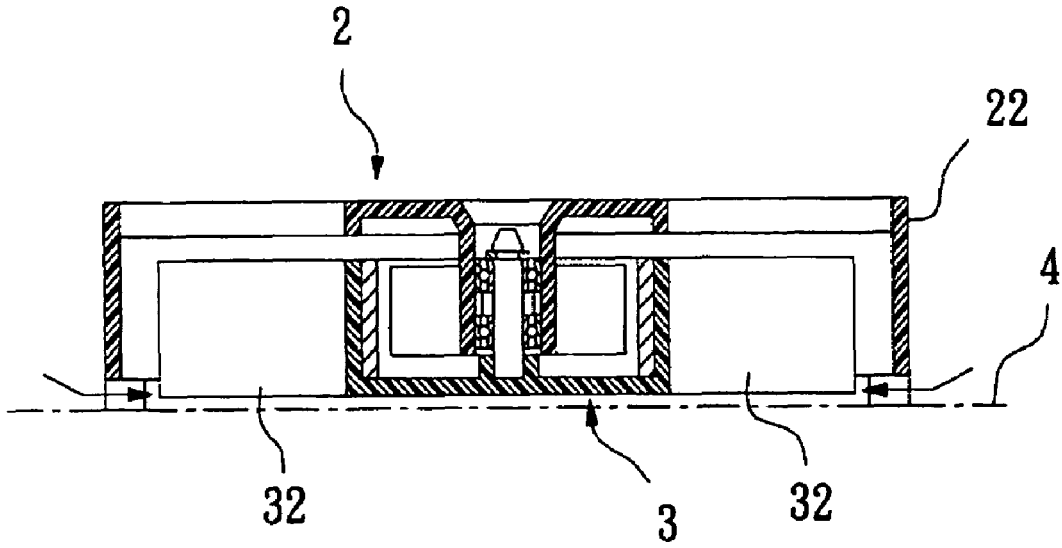
FIG. 4 is an another sectional view of the fan base case shown FIG. 2 illustrating the fan base being disposed horizontally but inversely.

2. It is not possible for the fan blades to touch the fan case base while the fan of the present invention is hung during being in use:

Referring to FIG. 4, the fan case base 2 can be hung in addition to being flatly touched to an article 4 such as the casing of a computer main unit. In this way, due to the fan blades 32 of the fan wheel 3 extending outward the air inlet side of frame 22 a height, the fan blades 32 are incapable of hitting the frame 22 in case of the fan wheel 3 slightly moving outward because of high speed rotation. Therefore, deficiency of the fan blades 32 and frame 22 being damaged resulting from hitting each other can be avoided.

Figure 5:
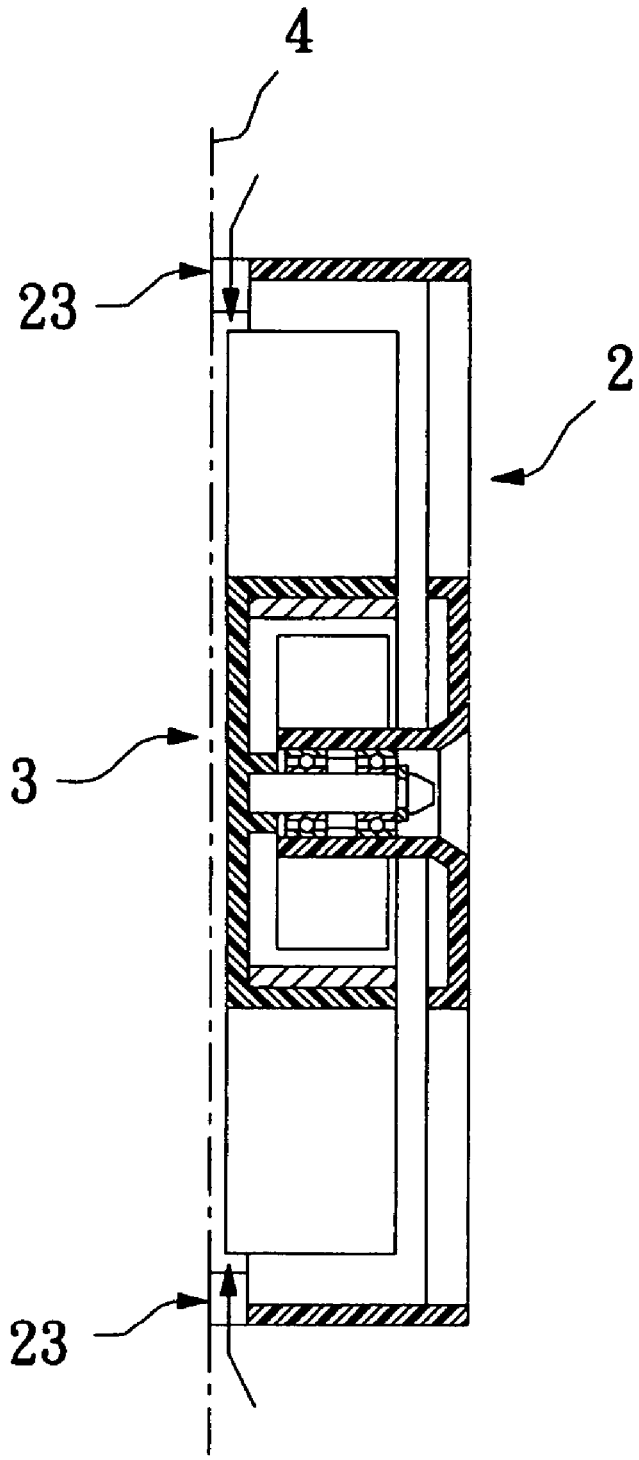
FIG. 5 is a further sectional view of the fan base case shown FIG. 2 illustrating the fan base case being hung vertically.

3. The present invention provides a function of cushion with shock absorption:

Referring to FIG. 4 in company with FIG. 3, an extremely large airflow route is formed in the frame 22 during the fan wheel 3 rotating with high speed and it results in the fan case base 2 swaying. Each engaging part 23 is made of rubber with cushion and shock absorption capability and the ring shaped element 231 of each engaging part 23 can be attached to the article 4 such as the casing of a computer main unit with a screw fastener (not shown) such that excellent cushion and shock absorption can be obtained effectively. Similarly, referring to FIG. 5, once the fan case base 2 of the present invention is hung vertically while in use, the excellent effect of cushion and shock absorption can be obtained under high speed rotation of the fan wheel 3 as well. Further, a steady and stable running of the fan can be maintained substantially.

Figure 6:
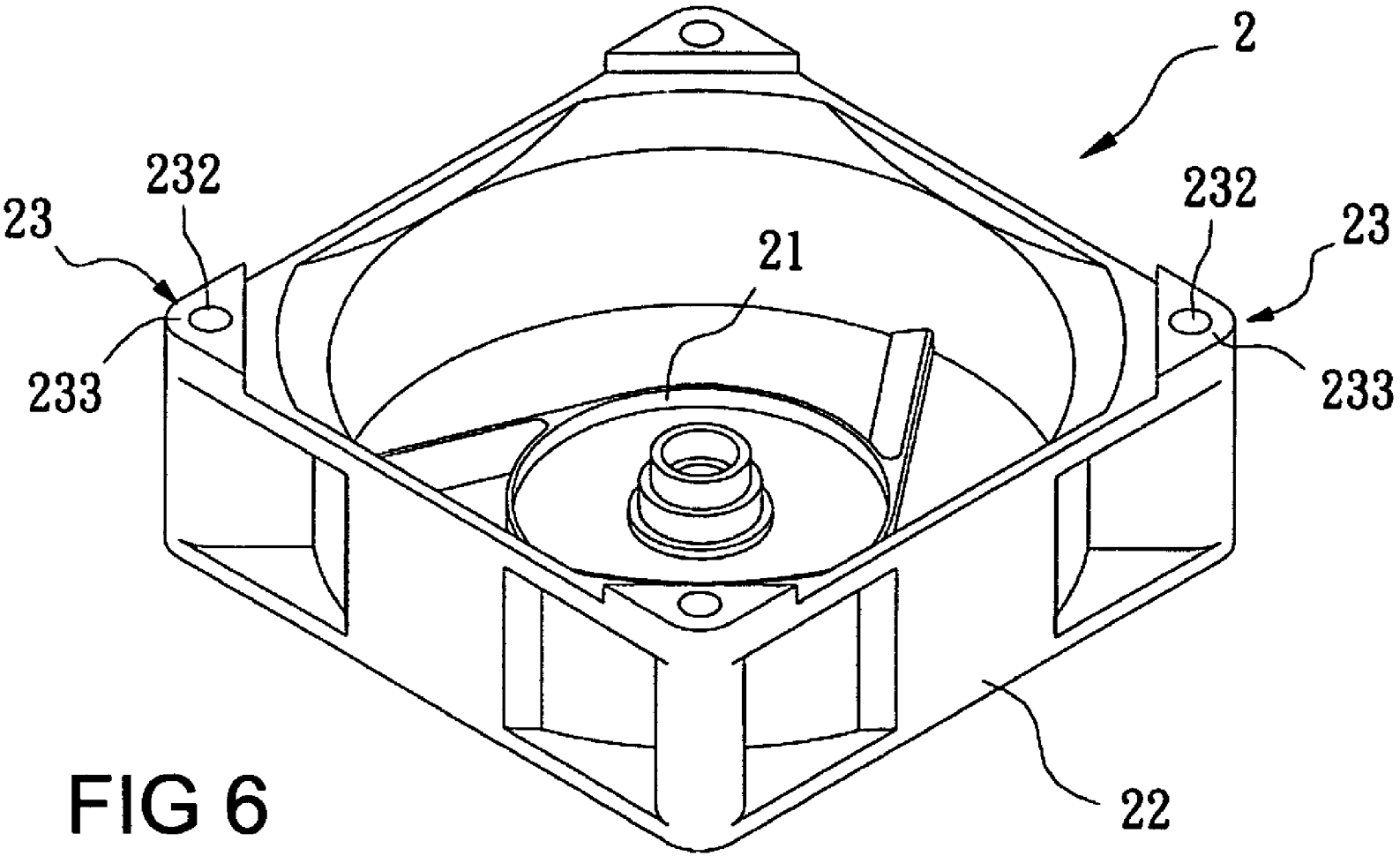
FIG. 6 is a perspective view of the second embodiment of a fan base case according to the present invention.

Referring to FIG. 6, the second embodiment of the fan case base 2 according to the present invention includes a base support 21, a frame 22 and four engaging parts 23. The difference of the second embodiment from the first embodiment is in that each engaging part 23 has a triangular projection 233 with a locating hole 232 passing through the projection 233. In practice, the triangular engaging part 23 also provides the same function as ring shaped element in the first embodiment such as lowering the turbulent flow and noise, enhancing the effect of cushion and shock absorption and avoiding the fan blades 32 of the fan wheel 3 hitting the frame 22.

It is appreciated that the fan case base 2 of the present invention can provide a better way for guiding the airflow, enhancing the effect of cushion and shock absorption and avoiding the fan blades 32 of the fan wheel 3 to hit the frame 22 even the fan case base 2 being hung vertically.

While the invention has been described with referencing to preferred embodiments thereof, it is to be understood that modifications or variations may be easily made without departing from the spirit of this invention, which is defined by the appended claims.

What is claimed is:

1. A fan case base, comprising:

a square frame with an air inlet side and an air outlet side, and having a hollow space between the air inlet side and the air outlet side;

a base support, being disposed at the center of the air outlet side and being joined to an inner wall of the hollow space;

a fan wheel with an outer lateral side, being received in the hollow space, having a hub being joined to the base support and the outer lateral side being disposed next to the air inlet side; and an engaging part, being disposed at four corners of the frame respectively;

characterized in that the outer lateral side of the fan wheel slightly extends outward the air inlet side of the frame and the engaging part slightly extends outward from the air inlet side of the frame in a way of the engaging part provides a first height greater than a second height between the air inlet side and the outer lateral side of the fan wheel such that a clearance is defined by the outer lateral side of the fan wheel, the engaging part and the air inlet side of the frame for air flow being guided through the clearance.

2. The fan base case as defined in claim 1, wherein the engaging part has a shape of ring.

3. The fan base case as defined in claim 1, wherein the engaging part has a shape of triangle.

* * * * *